United States Patent [19]

Rabus

[11] 3,935,554

[45] Jan. 27, 1976

[54] POLYPHASE LIQUID RHEOSTAT

[75] Inventor: Kurt Rabus, Heroldsberg, Germany

[73] Assignee: Siemens Aktiengesellschaft, Munich, Germany

[22] Filed: Mar. 26, 1975

[21] Appl. No.: 562,052

[30] Foreign Application Priority Data

Mar. 28, 1974 Germany ..... 2415089

[52] U.S. Cl. ..... 338/80; 338/82

[51] Int. Cl.[2] ..... H01C 10/02

[58] Field of Search ..... 338/38, 80, 81, 82, 83, 338/84, 85, 86, 99, 100, 114

[56] References Cited

UNITED STATES PATENTS

| | | | |
|---|---|---|---|
| 2,649,526 | 8/1953 | Benchemoul | 338/84 |
| 2,868,932 | 1/1959 | Schonhoff et al. | 338/80 X |
| 3,013,237 | 12/1961 | Bredchoeft | 338/80 |
| 3,181,099 | 4/1965 | McGivern et al. | 338/82 |
| 3,609,626 | 9/1971 | Beyrard | 338/80 X |

FOREIGN PATENTS OR APPLICATIONS

| | | | |
|---|---|---|---|
| 1,003,835 | 3/1957 | Germany | 338/80 |
| 1,948,381 | 4/1971 | Germany | 338/80 |

*Primary Examiner*—Volodymyr Y. Mayewsky
*Attorney, Agent, or Firm*—Kenyon & Kenyon Reilly Carr & Chapin

[57] ABSTRACT

In a polyphase liquid rheostat cells for separately accommodating adjustable electrodes with the cells filled with an electrolyte, covered at the top and open at one end face, are formed from electrically nonconducting plastic sheets which are welded together in a liquid tight manner with the welds arranged, at least in the zones which are subject to voltage stresses, so that they are adjacent only to external spaces which are free of liquid thereby preventing an electrical short circuit between cells of different phases in the case of a leak in the welded seam.

11 Claims, 6 Drawing Figures

POLYPHASE LIQUID RHEOSTAT

BACKGROUND OF THE INVENTION

This invention relates to polyphase liquid rheostats, of the type having electrodes arranged in insulated cells filled with an electrolyte which have their tops covered and are opened on end face, in general and particularly to an improved arrangement in such a rheostat which prevents electrical short circuits between phases should a leak occur.

A liquid rheostat is disclosed in German Pat. No. 1,003,835 in which an electrolyte tank having inside walls which are coated with rubber is subdivided by means of rubber coated partitions into cells for the electrodes which are opened at their end face. In front of the end faces room is provided for accommodating a cooling device which is arranged in the electrolyte tank. Should cracks or other faults occur in the easily damaged rubber, a voltage breakdown occurs which puts the entire piece of equipment out of operation.

To overcome such problems it has been proposed to place separate individual cells coated with rubber on the inside of an electrolyte tank in order to permit replacing a damaged cell with a new cell quickly and at low cost.

Because the construction and maintenance of cells coated with rubber is expensive and cells which are stored often suffer cracks in the rubber coating because of temperatture changes, there have been attempts to substitute for the cells coated with rubber, individual cells of an insulating material. Such is disclosed in German design Pat. No. 1,948,381. However, manufacturing such one piece cells requires a considerable expenditure for tooling and, in addition, requires separate mounting and stiffening means within the electrolyte tank to brace the flexible cells appropriately.

In apparatus using a fixed resistance, such as that used for a braking resistor in an electric machine, only a single electrode, fixed relative to the equipment, is provided in each cell and connected to a respective phase. The common neutral point is formed by the electrolyte outside the cells. In liquid rheostats the electrodes can be arranged such that they are adjustable in the horizontal direction, which requires a considerable expenditure of money for the electrical connections and the support members for the adjustable electrodes since the leads must be resistant to high voltage. In order to reduce these costs, it is known in the art to provide, for each cell, an electrode which is fixed relative to the equipment and is connected to an electric circuit, and an unconnected, horizontally adjustable counter electrode, the counter electrodes being electrically connected with each other in a simple manner so that essentially no current flows through the electrodes outside the cells. This is advantageous since it reduces heating and improves the accuracy to which the resistors can be adjusted. The arrangement for adjustment of the electrodes is, however, not the subject of the present invention. This information is provided solely for background. The object of the present invention is to provide an apparatus of the general type mentioned above which is operationally safe and uses cells which are easy to manufacture.

SUMMARY OF THE INVENTION

The present invention accomplishes its object in simple fashion by providing cells formed from electrically nonconducting plastic plates which are welded together in a liquid tight manner and in which the welds, at least in the areas which are subject to voltage stresses, are adjacent only to external spaces which are free of liquid.

The separate cells for the individual phases are arranged in a common electrolyte trough with the welds which are subject to stress enclosed by a liquid-free outer chamber or chambers which may be advantageously formed using plastic parts welded to each other and to the outer sides of the cells.

In accordance with a particularly advantageous embodiment of the present invention, an apparatus having an insulated tank divided into cells by insulating partitions and which is easy to manufacture and is an electrically safe design is obtained. This is done by providing that the electrolyte tank comprises side, intermediate, rear and bottom walls which are welded together so as to be liquid tight, along with a connecting flange on the front side, and having rear and bottom walls recessed relative to the outer edges of the side and intermediate walls by a leakage path corresponding to the electric voltage and whose connecting flange is connected with a terminating supplemental tank in a liquid tight but detachable manner. The structural unit comprising the tank and supplemental tank is surrounded by an outer support frame which mechanically braces the outer walls stressed by the electrolyte and which can be used at the same time as the support for the electrode setting devices.

The supplemental tank may comprise stainless steel material which is not rubber coated and may also contain a cooling unit. Plastic materials which may be used are polypropylene or low pressure polyethylene in the form of molded plates since such plates, in contrast to extruded products, have the same longitudinal changes in all directions due to temperature changes and as a result it is not possible for deformation of the cells or tanks which is not uniform to take place.

DETAILED DESCRIPTION OF THE PREFERRED EMBODIMENT

Figure 1:
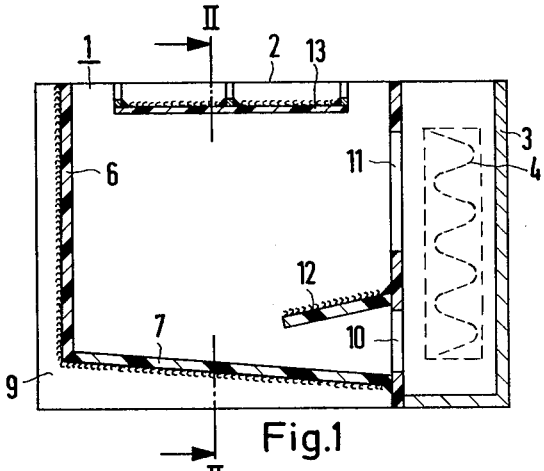
FIG. 1 is a longitudinal cross section through a triple cell with a supplemental tank according to the present invention.
Figure 2:
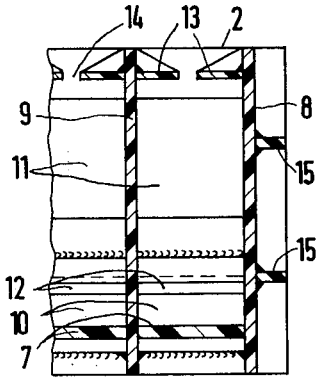
FIG. 2 is a cross section through a portion of FIG. 1 along the line I—I.
Figure 3:
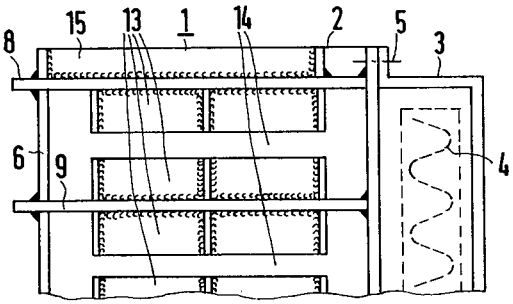
FIG. 3 is a plan view of a portion of the arrangement of FIG. 1.

FIGS. 1, 2 and 3 illustrate a polyphase liquid rheostat 1 comprising a triple cell 2 welded together from plastic plates and a supplemental tank 3. Supplemental tank 3 is connected in a detachable and liquid tight manner to the end face of the triple cell 2 by means of spring loaded connecting screws. It is designed to accommodate a cooling device 4. The supplemental tank 3, typically made of stainless steel sheet, is bolted to the connecting flange 5 of the triple cell 2 and sealed to the outside. On the side opposite the connecting flange a rear wall 6 is provided for each cell. The rear walls are welded to respective bottom walls 7. The bottom walls 7 are installed so that they are inclined rising from the connecting flange toward the rear wall. The bottom walls 7 are also welded to the connecting flange 5 as well as to the laterally confining intermediate and side walls 9 and 8 respectively. These lateral walls 8 and 9 protrude with their outer edges extending over the rear and bottom walls to form a leakage path. To obtain improved circulation of the electrolyte in each cell, and between cells and the supplemental tank, the connecting flange 5 is provided with a flange wall which has in front of each cell an inlet 10 opening at the height of the bottom wall 7 and an outlet opening 11 arranged above the former. A baffle 12 is welded to the upper edge of the inlet opening 10 and cooperates with the flange wall sidewalls, and intermediate walls to form a kind of inlet nozzle for the inflowing cooled electrolyte. Circulation is further improved by the inclination of the bottom walls 7.

For the purpose of covering the individual cells to reduce evaporation of the electrolyte, braced cover parts 13 are welded to the side walls 8 and intermediate walls 9 leaving a gap for electrode control members, which members are not shown. Since the triple cell 2 is installed along with its flange connected tank 3 in a dry place, the outer walls 8, in particular, are subjected to the weight of the electrolyte and must be braced accordingly. For this purpose, in addition to laterally welded stiffening ribs 15, at least the triple cell 2 portion of rheostat 1 will be surrounded by an outer support frame, not shown in detail, which can also be used to guide and support horizontally movable electrodes and counterelectrodes. In accordance with the manner in which apparatus of this nature is normally constructed it will be recognized that fixed electrodes will generally be arranged at the rear of each cell.

Figure 4:
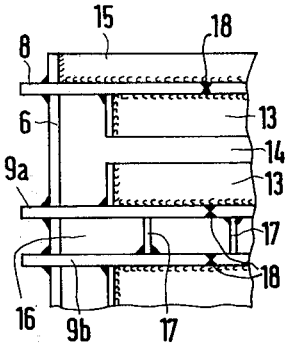
FIG. 4 is a plan view partially showing a triple cell with a double partition.

The individual walls of the embodiment of FIGS. 1, 2 and 3 are formed individual, molded polypropylene or low pressure polyethylene plates so that the liquid tight welds adjacent to the electrolyte are separated from each other by wall projections forming leakage paths and therefore cannot be stressed electrically. The use of molded plastic plates is essential because of their uniform expansion in all directions. Were they not used, deformation of the cells during operation with considerable temperature variations could occur. Extruded material, for example, would not be suitable for this purpose.

Where larger cells are constructed, the walls must be formed using several partial plates welded together. In such a case the welds in the partitions would also be subjected to a voltage stress. It could not be predictably insured that they could withstand this voltage stress. Therefore, in accordance with the present invention, as illustrated on FIG. 4, such partitions, where needed, are constructed as double partitions. That is, as shown on FIG. 4, the partitions 9 of FIG. 3 are replaced by a double partition **9*a* and 9*b* separated by an air gap 16. These partitions exist between each two adjacent cells and are braced against each other by means of spacers which are alternately welded to one and the other partition. In this manner the welds 18 are separated by the air gap 16** and will not be electrically stressed.

Figure 5:
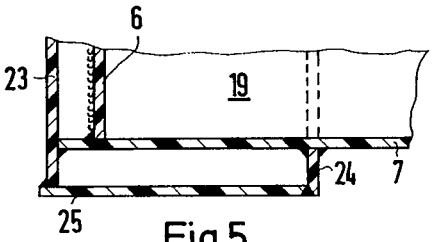
FIG. 5 is a longitudinal cross section through a single cell.
Figure 6:
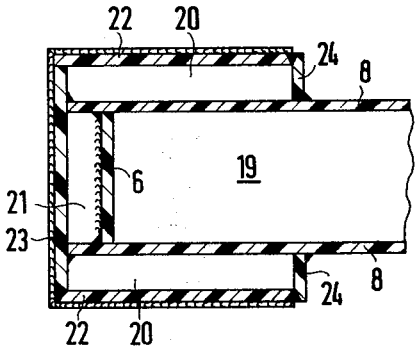
FIG. 6 is a plan view of a portion of the cell of FIG. 5.

In accordance with the present invention it is also possible to provide electrical relief for welded seams in single cells. This is illustrated by FIGS. 5 and 6 in which a single cell 19 which is to be lowered into an electrolyte tank, in a well known manner, is illustrated. In this embodiment parts identical to the parts of FIGS. 1, 2, 3 and 4 above are given identical reference numbers. As illustrated, the welds between the side walls 8 and the rear walls 6 and the bottom walls 7 are enclosed, at least in the areas at the end where voltage stresses are expected, i.e. where the electrodes (not shown) will be located, by outer chambers 20 and 21 which are free of liquid. These outer chambers are formed using plastic parts 22, 23, 24 and 25 which are welded to each and to the outer sides of the cells in a liquid-tight manner.

Thus, an improved arrangement for polyphase liquid rheostats has been illustrated and described. Although specific embodiments have been shown and described, it will be obvious to those skilled in the art that various modifications may be made without departing from the spirit of the invention which is intended to be limited solely by the appended claims.

What is claimed is:

1. In a polyphase liquid rheostat having electrodes arranged in insulated cells filled with electrolyte, said cells being covered at the top and opened at an end face, the improvement comprising cells formed from electrically non-conducting plastic plates which are welded together in a liquid tight manner and wherein the welds, at least in the areas which will be subject to voltage stresses, are located adjacent only to outer spaces which are free of liquid.

2. Apparatus according to claim 1 wherein the separate cells for individual phases are arranged in a common electrolyte tank and wherein said zones subject to voltage stress are enclosed by outer chambers which are free of liquid.

3. Apparatus according to claim 2 wherein said outer chambers are formed by plastic parts which are welded to each other and to the outer sides of the cells in a liquid tight manner.

4. Apparatus according to claim 1 in which an insulated tank subdivided in cells by insulated partitions is provided and wherein said tank comprises side walls, intermediate walls, rear and bottom walls welded together in a liquid tight manner, said insulated tank being provided with a connecting flage opposite said rear walls and wherein said rear and bottom walls are recessed from the outer edges of said side and intermediate walls to form a leakage path for the electric voltage and wherein said connecting flange is detachably connected to a terminating supplemental tank in a liquid tight manner.

5. Apparatus according to claim 4 wherein at least some of said walls comprise several plastic plates welded together in a liquid tight manner and wherein between each two adjacent cells two partition walls separated by an air gap and braced against each other by means of spacers alternately welded to one and the other partition are provided.

6. Apparatus according to claim 4 wherein said connecting flange contains, in the front of each cell, a flange wall having an inlet opening located at the height of the bottom wall and outlet opening situated thereabove.

7. Apparatus according to claim 6 wherein said bottom walls of the cells are slanted and rise toward said rear walls and wherein a baffle is provided between said inlet and outlet opening said baffle adjoining the flange wall and cooperating with the bottom wall, side and intermediate walls of each cell to form an inlet nozzle.

8. Apparatus according to claim 4 wherein the top sides of said cells are partially covered over their length by cover parts which are welded to the cell walls in a manner such as to leave a gap for electrode control elements.

9. Apparatus according to claim 4 and further including an outer support frame enclosing the structural unit made up of said tank and supplemental tank.

10. Apparatus according to claim 4 wherein said plates used to form said walls are of a material selected from the group consisting of molded polypropylene and molded low pressure polyethylene.

11. Apparatus according to claim 1 wherein said plates used to form said walls are of a material selected from the group consisting of molded polypropylene and molded low pressure polyethylene.

* * * * *